US012195995B2

(12) United States Patent
Massa

(10) Patent No.: US 12,195,995 B2
(45) Date of Patent: Jan. 14, 2025

(54) SWIMMING POOL STRUCTURE WITH WATER DRAWING, FILTERING AND RECIRCULATING CIRCUIT

(71) Applicant: MA. MI. INTERNATIONAL S.R.L., Lumezzane (IT)

(72) Inventor: Marco Massa, Bussolengo (IT)

(73) Assignee: MA. MI. INTERNATIONAL S.R.L., Lumezzane (IT)

( * ) Notice: Subject to any disclaimer, the term of this patent is extended or adjusted under 35 U.S.C. 154(b) by 55 days.

(21) Appl. No.: 17/802,788

(22) PCT Filed: Feb. 26, 2021

(86) PCT No.: PCT/IB2021/051622
§ 371 (c)(1),
(2) Date: Aug. 26, 2022

(87) PCT Pub. No.: WO2021/171247
PCT Pub. Date: Sep. 2, 2021

(65) Prior Publication Data

US 2023/0142536 A1 May 11, 2023

(30) Foreign Application Priority Data

Feb. 27, 2020 (IT) ..... 102020000004114

(51) Int. Cl.
*E04H 4/12* (2006.01)

(52) U.S. Cl.
CPC ..... *E04H 4/1227* (2013.01); *E04H 4/1245* (2013.01); *E04H 4/1272* (2013.01)

(58) Field of Classification Search
CPC ... E04H 4/1227; E04H 4/1245; E04H 4/1272; E04H 4/141
USPC ..... 4/491, 904
See application file for complete search history.

(56) References Cited

U.S. PATENT DOCUMENTS

| | | | | |
|---|---|---|---|---|
| 9,038,208 | B2 * | 5/2015 | Ferriss | A63B 69/125 4/492 |
| 2017/0058545 | A1 * | 3/2017 | Freeby | E04H 4/1227 |
| 2018/0135324 | A1 * | 5/2018 | Zars | E04H 4/1227 |
| 2021/0079676 | A1 * | 3/2021 | Meheux | E04H 4/1209 |
| 2021/0172187 | A1 * | 6/2021 | McDuffie | E04H 4/12 |
| 2021/0238875 | A1 * | 8/2021 | Essig | E04H 4/1227 |

FOREIGN PATENT DOCUMENTS

| | | | | |
|---|---|---|---|---|
| DE | 2550520 | A1 | 5/1977 | |
| FR | 2878550 | A1 * | 6/2006 | E04H 4/1227 |
| FR | 2916989 | A1 * | 12/2008 | B01D 29/27 |
| FR | 3075779 | A1 * | 6/2019 | B01D 35/027 |
| WO | 2003095767 | A1 | 11/2003 | |
| WO | 2004015225 | A1 | 2/2004 | |

OTHER PUBLICATIONS

International Search Report for PCT/IB2021/051622 dated Jun. 16, 2021 (3 pages).

* cited by examiner

*Primary Examiner* — Christine J Skubinna
(74) *Attorney, Agent, or Firm* — Tutunjian & Bitetto, P.C.

(57) ABSTRACT

The present invention relates to a swimming pool structure having at least one edge zone and a water collection, filtering and recirculation circuit, the latter including at least one well zone (WZ) for falling water, at least one filter mounted in the well zone and designed to intercept the water falling into it.

17 Claims, 3 Drawing Sheets

SWIMMING POOL STRUCTURE WITH WATER DRAWING, FILTERING AND RECIRCULATING CIRCUIT

TECHNICAL FIELD OF THE INVENTION

The present invention relates to a swimming pool structure as well as a method of maintaining a swimming pool structure.

STATE OF THE PRIOR ART

The pools, as regard to the water recycling and filtration system, are of two main types, skimmer pools and infinity pools.

Skimmer pools are the most common and have a perimeter edge outside the surface of the water on which the skimmer or spillway openings are distributed. The water is collected, filtered and re-introduced by means of these openings into the pool through special delivery vents.

The skimmers must be properly positioned and correctly sized, so as not to generate dead zones where water stagnates.

The infinity pools, on the other hand, are usually full to the brim and the water overflows around and flows into a special perimeter channel, thereby ensuring that the surface of the water is continuously and uniformly cleaned.

Infinity pools generally work well, but they are very expensive for their construction and, above all, for their operation.

The skimmer pools, on the other hand, cause a mixing of the water, but the corners of these pools always remain dirty.

Moreover, both in the case of infinity pools and in the case of skimmer pools proposed so far, compensation tanks as well as technical rooms are necessary that are difficult to maintain, mainly due to the hygienic conditions and the arrangement below the pools.

FR2878550A1, WO2004015225A1, WO03095767A1, FR2916989A1, DE2550520A1 teach respective solutions in accordance with the state of the prior art.

SUMMARY OF THE INVENTION

An object of the present invention is to provide a new swimming pool structure.

Another object of the present invention is to provide a swimming pool structure which is easy and economical to maintain.

Another object of the present invention is to provide a swimming pool structure which allows to obtain considerable energy savings with respect to the solutions proposed up to now.

Another object of the present invention is to provide a swimming pool structure with less noisy drive systems.

According to one aspect of the invention, a swimming pool structure is provided according to the present application.

The present application refers to preferred and advantageous embodiments of the invention.

BRIEF DESCRIPTION OF THE DRAWINGS

Other features and advantages of the invention will be more evident from the description of an embodiment of a swimming pool structure, illustrated by way of example in the accompanying drawings in which.

In the accompanying drawings, identical parts or components are indicated by the same reference numbers.

DETAILED DESCRIPTION OF THE INVENTION

Figure 1:
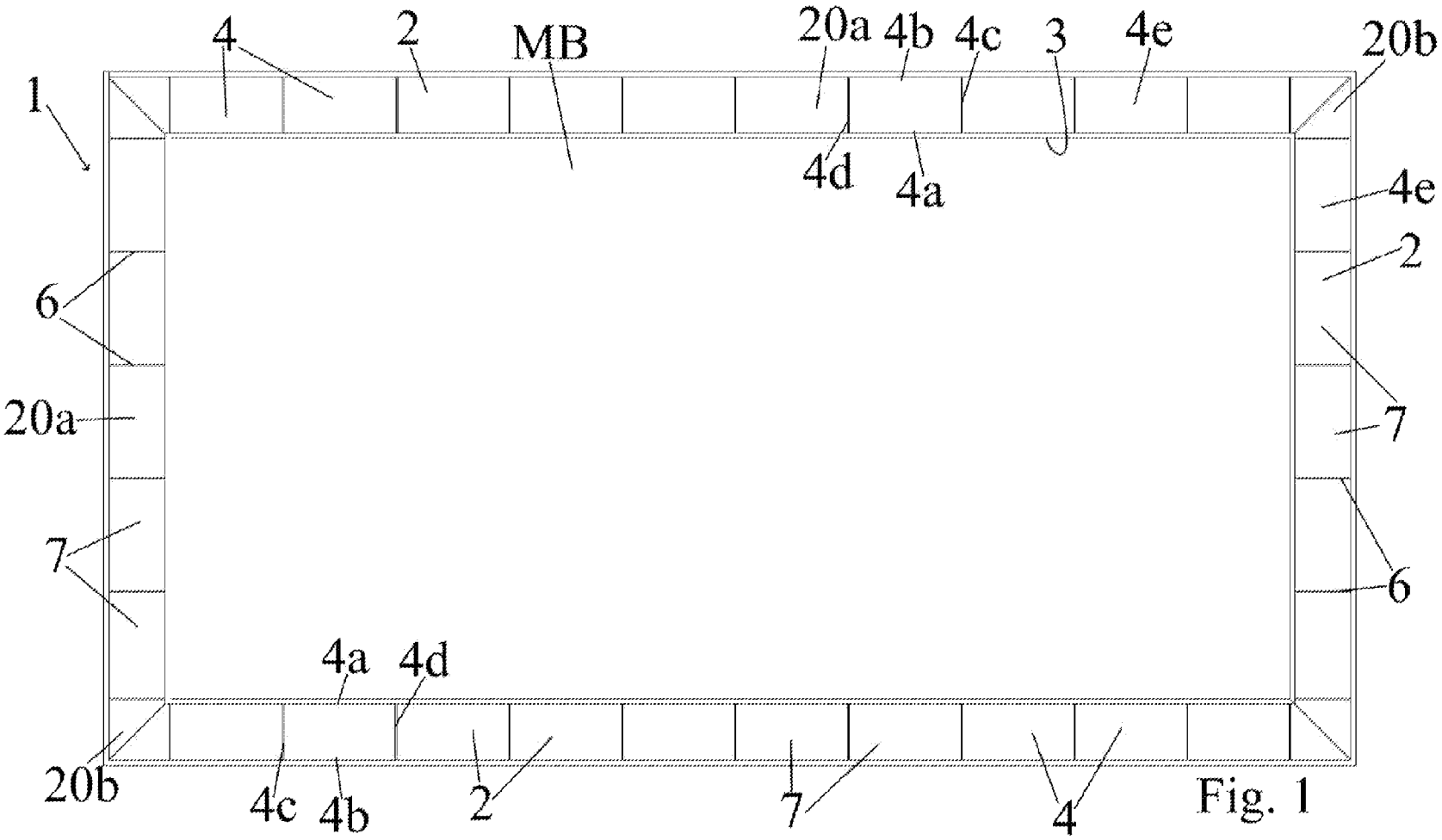
FIG. 1 is a top view of a swimming pool according to the present invention.
Figure 3:
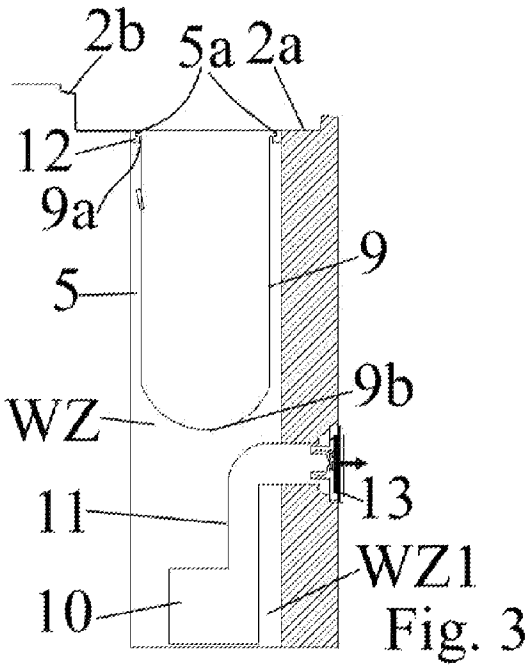
FIG. 3 is a view similar to FIG. 2 with parts removed.
Figure 2:
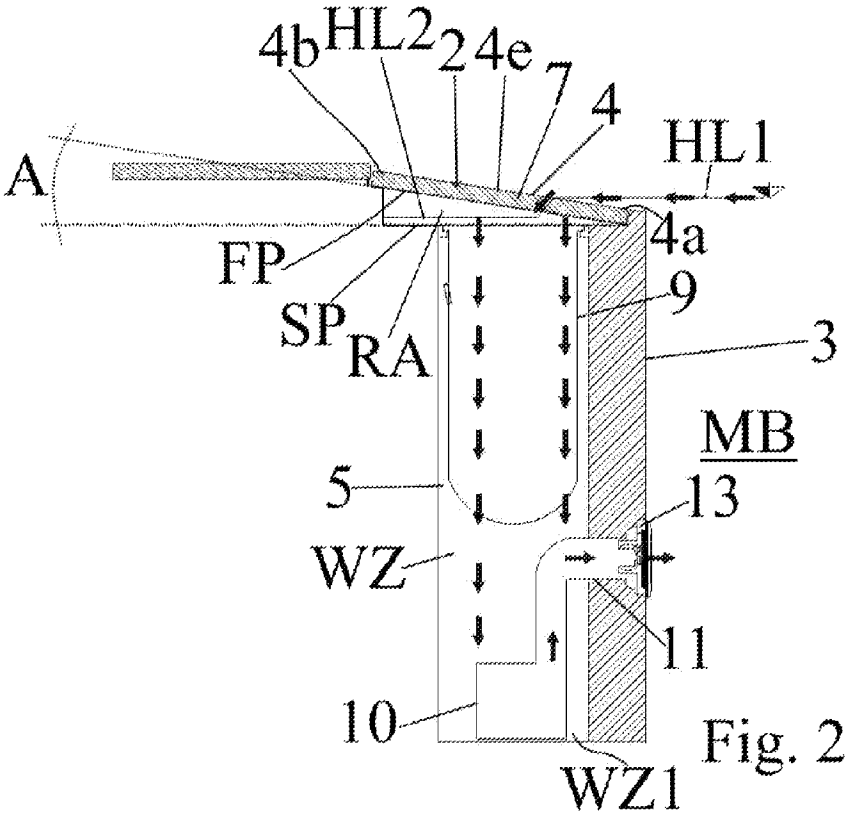
FIG. 2 is a cross-section view of a detail on an enlarged scale of the swimming pool structure of FIG. 1.

With reference to the attached figures, a swimming pool structure 1, for domestic or public use, has been illustrated, having at least one edge zone 2 with a first surface 3 which delimits and surrounds a main tub MB for water containment and at least a first top wall 4 designed to allow the passage of users from the outside towards the tank MB and from the latter towards the outside so as to allow them to enter and exit the tank MB.

The first surface 3 can be, in use, vertical or substantially vertical or even curved.

Of course, the edge zone 2 comprises a main block or structure made of suitable material, such as concrete, metal or other, and the first surface 3 is a free internal surface of this block, covered or not with tiles.

The top wall 4, on the other hand, can be rested or constrained at the top of this block, for example as will be better explained below, or it can be the top of this block.

Therefore, the top wall 4 surrounds all or, if desired, also part of the perimeter of the upper level of the main tank M B.

Moreover, the top wall 4 can be in contact with the first surface 3 or be slightly at a distance from it, for example between 1 cm and 10 cm, if desired between 1 cm and 5 cm.

The swimming pool structure 1 also includes at least one water collection, filtering and recirculating circuit 5 from/in the main tank MB. This circuit 5 is provided in the edge zone 2, for example it is formed in the possible main block of the edge zone 2. Basically, the circuit 5 extends entirely in the edge zone 2 under a portion of the top wall immediately above to it, that is to say entirely under a portion of the top wall 4 which constitutes the vertical translation of the same horizontal area where the circuit 5 is located.

The top wall 4 is defined by a series of adjacent and consecutive segments, which segments can each be formed by a respective component separate from the others or all in one piece or, alternatively, two, three or more units of segments, each in one piece only separate from the other units.

Advantageously, each segment of the top wall has a first front edge 4*a*, a second rear edge 4*b* and two respective side edges 4*c*, 4*d* which together with the first front edge 4*a* and the second rear edge 4*b* define the actual (if each segment corresponds to a respective tile) or ideal (if each segment corresponds to a part of the top wall 4, without the latter being made up of different elements or tiles placed side by side) perimeter of a segment of the top wall.

If desired, the first front edge 4*a* and the second rear edge 4*b* are parallel and/or the two side edges 4*c*, 4*d* are parallel. According to the non-limiting embodiment illustrated in the figures, the side edges 4*c*, 4*d* are orthogonal to the front 4*a* and rear 4*b* edges.

Clearly, the first front edge 4*a* is proximal to the tank MB, the second rear edge 4*b* is distal from the tank MB or at a distance from the latter greater than the first front edge 4*a* and the two side edges 4*c*, 4*d* each develop from a respective end of the first front edge 4*a* to a respective end of the second rear edge 4*b*.

It will be understood that each segment has a respective side edge 4*c* facing and substantially parallel or coinciding with a side edge 4*d* of a segment adjacent to it, while the first front edge 4*a* of a segment will be substantially aligned with or in any case will constitute the continuation of the first front edge 4*a* of a segment adjacent to it and the second rear edge 4*b* of a segment will be substantially aligned with or in any case will constitute the continuation of the second rear edge 4*b* of a segment adjacent to it.

Preferably, the top wall 4 has at least one respective segment inclined with respect to the horizontal and having at least one opening or groove 6 or in any case a structure such as to allow the passage of water through it in the direction from top to bottom so as to be conveyed towards the circuit 5, which extends starting from an area below this segment of the top wall 4 or in any case starting from a level lower than it, and is in fluid communication with the/and opening(s) or groove(s) 6 or with the porous surface of the segment so as to receive water, leaving the main tank M 13, which should pass through it.

If grooves 6 are provided, they could have a width, for example between 1 and 100 mm, if desired between 5 mm and 25 mm or between 8 and 15 mm.

The top wall 4 can be made of a suitable material, such as ceramic, marble, agglomerate, etc.

In the event that the top wall 4 must allow the passage of water, but it does not delimit through grooves, then it or the respective segment(s) can be made of porous material, if desired draining agglomerates with porosity for example between 10 and 500 m2 g−1.

Preferably, the top wall 4 or better each segment thereof has the first front edge 4*a* in contact with or resting on a first part 2*a* of the edge zone 2 proximal to the first surface 3 and the second rear edge 4*b* in contact with or resting on a second part 2*b* of the edge zone 2 distal from the tank MB with respect to the first surface 3.

Advantageously, but not necessarily, the top wall 4 or better the respective segments are kept in position only by gravity or according to their own weight and are not bound, for example by means of a special mixture, such as cement, to the other components of the swimming pool structure 1 or better to the main block.

With reference to at least one segment of the top wall 4, it has the respective first edge 4*a* at a level, in use, that is lower i.e. vertically lower than the second edge 4*b*, so that the angle A defined between the portion of a first plane FP connecting the first edge 4*a* and the second edge 4*b* of the respective segment and the portion of a second horizontal plane SP underlying this portion of the first plane FP is greater than 0°. Advantageously, this angle ranges between 5° and 60° or between 50 and 250 and even more advantageously between 5° and 10°.

Basically, at least one segment 7 of the top wall 4 is substantially inclined with respect to the horizontal so that the respective level or vertical position decreases as it approaches the main tank M B.

The length of this segment of the top wall 4, i.e. the distance between the first 4*a* and the second 4*b* edge, can be for example between 5 cm and 100 cm, if desired, about 20-25 cm.

Advantageously, the first edge 4*a* and the second edge 4*b* are preferably parallel to each other and with a main extension dimension which is horizontal and lying in a vertical plane parallel to the plane where the first surface 3 lies, or better the portion of first surface 3 closest to this first and second edge 4*b*. This condition must therefore be evaluated as a function of the part of the edge zone 2 considered from time to time, since the first surface 3 has a different arrangement according to the respective part of the edge zone 2 and the same applies, clearly for the edges 4*a* and 4*b* from time to time concerned.

The angles and dimensions of the components now indicated must in any case be such as to allow users to enter and exit the tank MB, without them slipping. In this regard, the top wall 4 or one or more segments thereof can be made or covered with a suitable anti-slip material.

Moreover, the dimensions and inclination of the top wall 4 or of one or more segments 7 of the same also serve to improve the hydraulic containment system of the pool.

Each segment can be constituted in particular by a respective tile 7, so that there would be a plurality of tiles 7 side by side and, if desired, bound together to define the top of the edge zone 2. The tiles 7 would in this case be arranged side by side to the other until the top wall 4 is formed. Clearly one or more tiles 7 could be fixed with a suitable mixture, for example cement, and others could instead only be placed on respective supporting parts. The latter could be easily disassembled to access the circuit 5 or the inlet opening 5*a* of the same.

In this case, one or more or clearly all the tiles 7 could be inclined as indicated above.

The tiles 7, if provided, have any suitable configuration, for example square or rectangular, with sides parallel two by two, two 4*c*, 4*d* inclined according to the angle A with respect to the horizontal as indicated above and two 4*a*, 4*b* with horizontal main extension and lying in a vertical plane parallel to the plane where the first surface 3 lies or, better, the portion of the first surface 3 closest to such first and second edges 4*b*.

As indicated above for the segments, the tiles 7 are preferably placed side by side with the same inclination and respective sides in contact or in any case adjacent along straight portions 20*a* of the edge zone 2, while the curved parts or the corners 20*b* of the edge zones could be obtained by appropriate shaping of the tiles 7.

Advantageously, the top wall 4 delimits at least a through groove 6, which can have a trim or attitude inclined with respect to the horizontal.

In this regard, a plurality (two, three, four or any number greater than ten, twenty, etc.) of through grooves 6 suitably spaced can be provided. These grooves 6 can be delimited one or more in each tile 7 and/or defined between adjacent tiles 7.

If the top wall 4 is composed of tiles 7, then, as already partially indicated above, the through grooves 6 can (although this is clearly not a necessary condition) be aligned on two sides 4*c*, 4*d* of a respective tile 7 and they can be formed in the middle of the latter or between pairs of adjacent tiles 7.

The length of the grooves 6 can be any suitable length, for example between 1 mm and 1000 mm, for example between 100 mm and 800 mm or between 500 mm and 800 mm.

Advantageously, the first part 2*a* of the edge zone 2 is at a lower level than the second part 2*b*.

Moreover, the intermediate portion 4*e* of at least one segment (or all the segments) of the top wall 4, which extends between the first edge 4*a* and the second edge 4*b*, is not supported from below by the main block of the edge zone 2, i.e. the latter has a recessed area RA which subtends the intermediate portion 4*e* of the aforementioned segment 7 of the top wall 4.

Therefore, the recessed area RA constitutes a sort of channel, if desired perimeter, for conveying water.

In accordance with the present invention, a first higher level HL1 of the water in the tank MB can be obtained, while in the recessed area RA a second upper level HL2 is obtained which is lower, for example by two, three, four, five or more cm with respect to the first upper level HL1, so that the water is actually dragged towards the recessed area, through the groove/s 6 or the porous structure of the inclined segments of the top wall 4, and thus an acceleration of the flow of water through the top wall 4 or one or more segments thereof.

Basically, at least one segment 7, but preferably some or all of the segments of the top wall 4 is/are supported only at the respective edges 4*a*, 4*b* and not at the respective intermediate portion 4*e*. In such case, of course, the edges 4*c*, 4*d* would not be supported either. Alternatively, intermediate support bridges could be provided for the segments or tiles 7.

The above can be obtained by suitably shaping the main block of the edge zone 2 or also the tiles 7.

Clearly a segment or tile 7 always has the same position or attitude moving in the direction from one side to the other of the segment or in any case along the perimeter development direction of the respective part of the edge zone 2.

Thus, for example, considering a swimming pool structure 1 with a rectangular edge zone 2, with two major sides and two minor sides as illustrated in the non-limiting embodiment of FIG. 1, then the segments or tiles 7 may or may not always have the same position along a direction parallel to the respective side (greater or lesser) to which the segment under examination belongs. In this regard, depending on the type of laying of the flooring around the main tank MB, the arrangement of the tiles in the edge zone may vary.

If a segment belonged to a curved part of the edge zone 2 then the position of this segment would remain the same parallel to the development of this curved part.

With regard to the collection, filtering and recirculation circuit 5, as indicated above, it develops from an area below the top wall 4 and is in fluid communication with the opening(s) and/or groove(s) 6 or with the porous surface of the top wall 4 so as to receive water which should pass through it.

More particularly, the circuit 5 has at least one inlet mouth or opening 5*a* opening under the top wall 4 or a segment 7 thereof and in particular under the intermediate portion 4*e* or an intermediate portion 4*e*.

The inlet mouth or opening 5*a* can, for example, have a circular, square, rectangular or other type section.

The inlet mouth or opening 5*a* can subtend and have a diameter or a size corresponding to at least half or at least two thirds of the distance between the first edge 4*a* and the second edge 4*b* of an overlying segment 7.

If desired, the inlet mouth or opening 5*a* is delimited or formed in the first part 2*a*. Thus, for example, the inlet mouth opening 5*a* can be delimited in an intermediate or substantially central portion of the third section 2*a*, so that the first part 2*a* has a portion close to or proximal to the first surface 3 and a portion distal from the first surface 3 from which a fourth section 2*e*, if provided can extend upwards.

Naturally, two or more inlet mouths openings 5*a* could be provided, for example four or more suitably distributed along the perimeter of the edge zone 2.

In this case, a plurality of grooves 6 or porous tiles 7 could be provided, all opening below on the first part 2*a*, so as to convey the pool water to be filtered towards the inlet openings 5*a*.

In accordance with this variant, in order to ensure that the water passed through the grooves 6 or through the porous body of the tiles 7 is conveyed towards the inflow openings 5*a*, then the first part 2*a* could be made of segments with different inclination so as to have a level or vertical position which decreases as it approaches the inlet openings 5*a*, so as to obtain a sort of funnel effect. This condition is of course not necessary, also considering the suction effect determined by the pumps or similar means provided in circuit 5.

As regards in detail the water collection, filtering and recirculating circuit 5 in the main tank MB, it comprises at least one well zone WZ for falling water arranged under the top wall 4, at least a filter 9, for example a bag filter, mounted in the well zone WZ and designed to intercept the water falling into it starting from the top wall 4. The circuit 5 then includes recirculation or movement means, such as a recirculation pump or fan or propeller 10, if desired placed in a portion WZ1 of the well zone WZ downstream of the filter 9 or in any case arranged or mounted on the bottom WZ1 of the well zone WZ or in a position lower with respect to the filter 9. According to this, the recirculation or movement means 10 are crossed by water already filtered by the filter 9. Actually, the recirculation or movement means 10 are immersed in water, which is in the well zone WZ.

As it will be possible to ascertain, according to the non-limiting embodiment shown in the figures, the water crosses the filter by gravity, according to the sieve principle.

Each well zone WZ is accessible from the top passing through a respective mouth or inflow opening 5*a*. In this case, each well zone WZ will be under a respective segment of the top wall 4.

Therefore, several well zones WZ can be provided, if desired, two, three, four or more, each served by a respective inlet mouth or opening 5*a*.

If several well zones WZ are provided, they are distributed along the perimeter of the edge zone 2, so as to be suitably spaced from each other.

One or more well zones WZ can have a cross section, taken along a horizontal plane, which is circular or square or rectangular or L-shaped of other suitable shape which polygonal or not polygonal. The cross section of a well zone is preferably substantially constant along a vertical direction.

Advantageously, the cross section of a well zone WZ could be between 5 and 150 cm.

Preferably, a well zone WZ could then extend starting from a few cm, for example between 1 and 20 cm below the top wall 4 and up to a level lower among 1 and 50 cm with respect to the top wall 4.

With reference to the minimum distance from a well zone WZ of a main tank MB or more particularly with respect to a first surface 3, it can be between 5 and 50 cm. This distance must clearly be considered between a well zone WZ and the part of the first surface 3 closest to it.

An operator can therefore easily reach the bottom of the well zone WZ starting from the edge zone 2 by optionally removing a segment or tile or grid of the top wall 4 above the well zone WZ, this being done by inserting an arm within the well zone WZ starting from the inlet mouth or opening 5*a*, which is exposed once an overlying segment or tile or grid has been removed.

As it will be possible to ascertain, a swimming pool structure 1 with collection, filtering and recirculation circuit 5 according to the present invention could also not include an edge zone 2 structured as indicated above, and thus with a top wall with one or more segments inclined as described above.

In this regard, such a filtering circuit 5 could also be mounted in a traditional infinity pool or even a skimmer pool.

Therefore, one or more well zones WZ could also be mounted under the grids, so that it is possible that the top wall includes one or more grids arranged above one or more well zones WZ. In this case, the opening or openings in the top wall could be delimited by the grids.

Advantageously, the top wall 4 or better a respective segment or a respective grid above or immediately above a well zone WZ is kept in position only by gravity or according to its own weight and is not bound by cement to the other components of the swimming pool structure 1 or better to the main block. Clearly, removable constraining means may be provided, such as hooks, screws, bolts or the like designed to detachably hold such a segment or grid to adjacent components of the top wall, without however preventing its disassembly or removal.

Basically, the grid or the segment above or immediately above a well zone WZ can be dismountable or removable or extractable manually or by means of a special tool (such as a screwdriver) without it being required to break it or to break the components around it, so as to allow easy access to the well zone WZ or to a respective inlet mouth or opening 5*a*.

With the expression immediately above, it is intended the vertical translation of the same horizontal area.

Of course, a well zone WZ could also be entered from a segment of the top wall slightly to the side with respect to the vertical continuation of the well zone WZ.

The components of the collection, filtering and recirculation circuit 5 are compatible with all water sanitation substances and systems.

As regards the filter 9, a respective bag filter 9 can be mounted in each well zone WZ, which filter is sock-shaped with a first end 9*a* open (which therefore allows water to enter the filter 9, without that, however the end 9*a* determines a preventive filtering action) and a second closed opposite or filtering end 9*b*; clearly the term "closed" does not mean that the second end 9*b* does not allow the passage of water, but only that the water cannot pass through it without being filtered, precisely because it must pass through the meshes or in any case the material of the bag filter 9.

The filtering area, i.e. the surface of the filter designed to intercept and filter the water that passes into each well zone WZ, could be for example between 0.30 and 2 $m^2$.

In this case, the first end 9*a* is advantageously mounted or constrained at the inlet mouth or opening 5*a* by means of one or more suitable blocks or connection means or the like 12, in particular so that the seal is maintained between the end 9*a* and the wall delimiting or defining the inlet mouth or opening 5*a*, so that all the water entering the well zone WZ necessarily passes through the filter 9.

According to a non-limiting variant, the filter is connected by means of a double guide system, i.e. a first guide which is structured in such a way as not to allow the filter to exit during the normal floating phases with the pumps off and an upper, in use, second guide that houses a roughing basket that can contain slow-dissolving chemicals, such as chlorine tablets.

The filter 9 could be made of a low resistance filtering material, for example it could include a bag or a net, in particular resistant to salt and chlorine and, if desired, machine washable.

The porosity of the filter 9 can be any suitable one, for example between 10 and 200 microns, if desired between 50 and 120 microns, for example about 60-70 or 90-100 microns.

Clearly, by reducing the number of microns of porosity, the meshes or passage areas are reduced and a better filtering of the water is obtained, but, on the other hand, by reducing the meshes or passage areas too tightly, the filter is more easily clogged.

Of course, instead of a bag, one could use another type of filter, such as a filter mass or a cartridge.

The filter 9 is preferably anti-bacterial, algaecidal and washable.

At least one recirculation duct 11 of the water conveyed by the pump or fan 10 opening into the tank MB is also provided in circuit 5. Such recirculation duct 11 can extend between the outlet of the pump or fan 10 and a discharge opening or through hole extending in a side wall or portion of side wall 1*a*, if desired of the main block, between a respective well zone WZ and the tank MB. The recirculation duct 11 can then be provided with a special nozzle for dispensing water in the tank MB.

Basically, the recirculation duct 11 opens into the first surface 3 or better into the side wall 1*a* below the top wall 4.

Quick or interchangeable coupling or attachment means 13 of the duct 11 in the discharge opening or through hole as well as even with the exit of the means 10 or the pump 10.

The swimming pool structure 1 can also include an overflow opening which is in fluid communication with the sewer, so that if too many people or in any case when a certain number of people enter the tank MB, the water in the latter is discharged into such opening.

With regard now to the recirculation or movement means, the same could include a low voltage pump, for example pumps from 12 to 24 volts to move 10 cubic meters/h, if desired of 90 W. This is possible thanks to the structure of the circuit 5 which extends immediately under the top wall 4 in a shallow well zone WZ, unlike the solutions proposed so far which instead have very extensive filtering and recirculation circuits, which require the use of much more powerful pumps.

The use of one or even more (three-four) of these pumps would clearly allow for significant energy savings compared to traditional solutions, which usually use 580 W high voltage pumps to move 10 cubic meters/h.

The pump 10 can be arranged on the bottom WZ1 of the well zone WZ and can be constrained on this bottom WZ1, by means of suitable removable constraining means, such as screws or the like, or also free or in any case kept in position by the respective weight. In any case, advantageously, the pump 10 can be easily dismountable or extractable from the well zone WZ by manual intervention by an operator, if decided, with a suitable tool, such as a screwdriver.

For the power supply of the recirculation or movement means 10, a cable can be provided that is suitably guided out of the well zone WZ towards a junction box or a long cable. Of course, a power supply of the recirculation or movement means by battery or solar energy can also be provided.

The recirculation or movement means 10 may be such as to stop when there is no more water, therefore essentially when the voltage is too low and could also be of the variable speed type.

Figure 4:
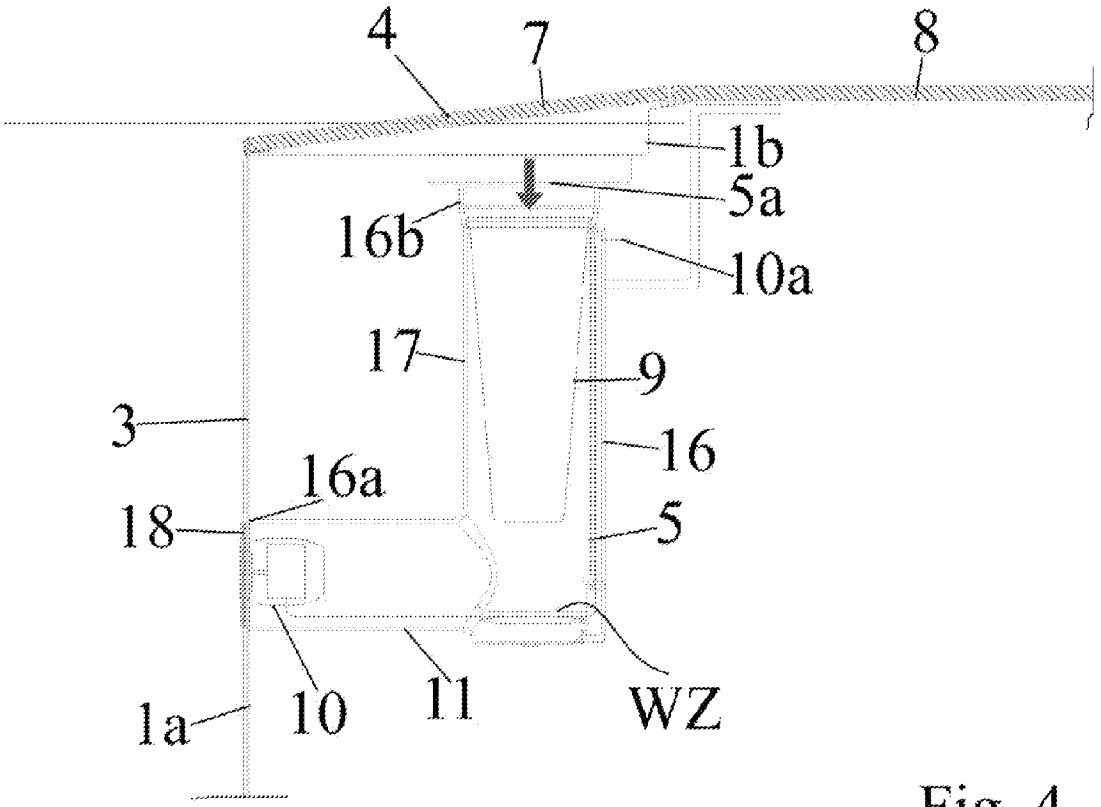
FIG. 4 is a schematic view of a detail of another embodiment of a swimming pool structure according to the present invention.

With reference now in particular to FIG. 4, a variant of the present invention has been illustrated, in which the collection, filtering and recirculation circuit 5 can also comprise a tubular element 16, if desired L-shaped or also with other geometry, a first end 16 thereof is fastened, for example by means of screws, bolts, welding, fitting to a side wall 1*a* of the swimming pool structure defining the first surface 3. More particularly, the end 16*a* is mounted in a discharge opening or through hole defined in the side wall 1*a*.

The other or second end 16*b* of the tubular element 16 is instead fixed, for example by means of screws, bolts, welding, fitting under a top wall 1*b* of the swimming pool structure 1. Naturally, the top wall 1*b* defines the parts 2*a*, 2*b* on which a top wall 4 can then be laid.

The tubular element 16 can be made of any suitable material, for example plastic or a composite material.

Clearly, the top wall 1*b* can be fixed either in one piece with the side wall 1*a* and can extend, if desired, also cantilever extend, from the latter.

In this case, the recirculation duct 11, which opens into the tank MB, could constitute an end portion, if desired horizontal or slightly inclined with respect to the horizontal, of the tubular element 16, which could also include a supply duct 17, in use, substantially vertical or inclined with respect to the vertical, which extends between the inlet mouth or opening 5*a* and the recirculation duct 11.

With reference therefore to the non-limiting embodiment of FIG. 4, the collection, filtering and recirculation circuit 5 includes only the ducts 11 and 17.

The recirculation or movement means, such as a pump or fan or propeller 10, could be mounted in any point of the tubular element 16, for example at the first end 16*a*, i.e. in the same or at 1-10 cm from it.

If desired, a containment component 18, such as a grid, can also be provided, which is removably mounted (by means of screws, bolts or other) on the first end 16*a* and designed to contain the recirculation or movement means 10 inside the tubular element 16.

Clearly, also in this case, for supplying the recirculation or movement means 10, a cable 10*a* can be provided which is suitably guided within the tubular element 16 and from this out of the well zone WZ towards a junction box or a long cable. Of course, a power supply of the means of recirculation or movement by battery or solar energy can also be provided.

According to this variant, the filter 9 would extend preferably from the inlet mouth 5*a* inside the supply duct 17 and would extend less than the latter.

The pump 10 can be equipped with electronics designed to read the voltage variations in order to detect the possible no-load operation, i.e. the lack of water which can be caused by clogging of the filter or too low level in the pool or by obstruction of the duct 11, also established by the operator. In the latter case, if the pump is clogged for a certain period, for example more than 5 seconds, the voltage variation is detected, so the pump switches off and then restarts, but it switches off again if the problem or the clogging persists, as long as the pump could be blocked permanently and emit a pump stopped signal.

In accordance with the present invention, a maintenance method for a swimming pool structure is also provided which first comprises disassemble or remove, without the need to break, for example manually or by means of a suitable tool, a segment or tile or grid of the top wall above the well zone WZ so as to be able to access the latter and thus to disassemble or extract, manually or by means of a special tool, the filter 9 and optionally disassemble and extract, manually or by means of a special tool, the recirculation or movement means, for example a pump 10.

These phases can be carried out by an operator remaining in fact, for example on his knees, at the edge zone 2 and inserting one or both arms, starting from this edge zone 2, in the well zone, thereby easily reaching the filter 9 and, if necessary the pump 10

With reference then to the variant of FIG. 4, the pump 10 could be extracted starting from the main tank MB, by first disassembling the containment component 18 and thus arriving at the pump 10.

As it will be possible to ascertain, thanks to the present invention, it is possible to completely disassemble the filter 9 and the recirculation or movement means, such as a pump or fan or propeller 10, even without lowering the water in the pool. In order to do this, it would be sufficient to lift or move, manually or by means of a suitable tool, one or more tiles 7 or grids of the top wall 4 and then extract, even manually the respective the filter 9 and, if necessary, the pump or the recirculation or movement means 10, for example by disengaging the quick fitting or coupling means.

It is also possible to notice how all the components of the system which can undergo wear are in an easily accessible area and can be changed without any problems.

In the solutions proposed so far, instead should maintenance be made, it is necessary to access technical rooms where there is water, humidity and high voltage, as well as often dirt, a condition that obviously does not occur in accordance with the present invention.

There is also no need for underground pipes, which, like the technical rooms, are difficult to maintain.

Moreover, the arrangement of the recirculation or movement means 10 downstream of the filter 9 ensures that the recirculation or movement means 10 are crossed by water already filtered by the filter 9, unlike traditional systems in which the pump moves water before the filter.

In view of this, the pump does not need maintenance or in any case need of maintenance less than the systems proposed up to now. With regard to this aspect, usually the management of traditional swimming pools is carried out automatically, but this does not apply to the cleaning of the pump, which, being usually upstream of the filter, is crossed by water to be filtered and must be cleaned thoroughly manually.

Moreover, again in accordance with the advantageous embodiment described, the pump or the means 10 must not push water through a filter, so that the pump, which runs almost free, works at maximum efficiency and can also be at low power.

The position of the recirculation or movement means 10 according to the preferred embodiment illustrated in the figures, also guarantees the silence of the system, because the means 10 are at the bottom of the well zone WZ, considering what is indicated above in relation to the power of the means 10 or usable pumps.

It will then be understood how the possibility (thanks to the structure of the circuit 5 which extends immediately under the top wall 4 in a shallow well zone WZ) of using low voltage pumps or pumps with a power of 0.09 kW, makes it possible to obtain significant energy savings compared to traditional solutions, which usually use 1.00 kW pumps.

Changes and variants of the invention are possible within the scope defined by the claims.

The invention claimed is:

1. A swimming pool structure having at least one edge zone including a first surface which delimits and surrounds a main tank (MB) for water containment and at least one top wall designed to allow users to enter and exit the tank (MB), said swimming pool structure also comprising a water collection, filtering and recirculating circuit in the main tank (MB), wherein said water collection, filtering and recirculation circuit for collecting water from the main tank (MB) and recirculating water in the main tank (MB) includes at least one well zone (WZ) arranged under the top wall, at least one filter mounted in the well zone (WZ) and designed to intercept water falling into the filter starting from the top wall, said circuit including recirculation or movement means always placed in the well zone (WZ), wherein said water collection, filtering and recirculation circuit comprises at least one recirculation duct of the water conveyed by the movement means, wherein said at least one recirculation duct opens into the main tank (MB), wherein said at least one recirculation duct extends between the outlet of the pump or fan and a discharge opening or through hole extending in a wall or portion of wall between a respective well zone (WZ) and the tank (MB).

2. The swimming pool structure according to claim 1, wherein said recirculation or movement means are arranged in a portion (WZ1) of the well zone (WZ) downstream of the filter or on the bottom of the well zone (WZ) or in a position lower with respect to the filter, so that the recirculation or movement means are crossed by water already filtered by said at least one filter.

3. The swimming pool structure according to claim 2, wherein said recirculating or movement means comprise a low voltage pump.

4. The swimming pool structure according to claim 1, wherein said well zone (WZ) has a cross section, taken along a horizontal plane, which is circular or square or rectangular or of other polygonal shape.

5. The swimming pool structure according to claim 1, wherein said at least one well zone (WZ) extends starting from between 1 and 20 cm below the top wall and up to a lower level between 1 cm and 50 cm with respect to the top wall.

6. The swimming pool structure according to claim 1, wherein said filter is a bag filter.

7. The swimming pool structure according to claim 6, wherein said filter has a sock-like configuration with a first end open and a second closed opposite or filtering end, said first end being mounted or constrained at the inlet mouth or opening by means of one or more suitable blocks or connection means, so as to maintain the seal between the first end and the wall delimiting or defining the inlet mouth or opening.

8. The swimming pool structure according to claim 1, wherein said collection, filtering and recirculation circuit is in the edge zone.

9. The swimming pool structure according to claim 8, comprising means for quick or interchangeable coupling or attachment of said at least one duct into the discharge opening or through hole.

10. The swimming pool structure according to claim 1, wherein said collection, filtering and recirculation circuit is located below the top wall and is in fluid communication with an opening or groove formed therein or with a porous surface of the top wall so as to receive water that should pass through it, said circuit having a mouth or opening opening below the top wall.

11. The swimming pool structure according to claim 1, wherein said recirculation duct opens into the first surface under the top wall.

12. A swimming pool structure having at least one edge zone including a first surface which delimits and surrounds a main tank (MB) for water containment, and at least one top wall designed to allow users to enter and exit said tank (MB), said swimming pool structure also comprising also a water collection, filtering and recirculating circuit in the main tank (MB), in which said water collection, filtering and recirculation circuit for collecting water from the main tank (MB) and recirculating water in the main tank (MB) includes at least one well zone (WZ) arranged under the top wall, at least one filter mounted in the well zone (WZ) and designed to intercept water falling into the filter starting from the top wall, said circuit including recirculation or movement means placed in the well zone (WZ), wherein said water collection, filtering and recirculation circuit comprises at least one recirculation duct of the water conveyed by the movement means, wherein said duct opens into the main tank (MB), wherein said collection, filtering and recirculation circuit comprises a tubular element having a first end fixed to a side wall of the swimming pool structure defining the first surface, and wherein a second end of the tubular element is fixed below a top wall of the swimming pool structure defining the first part of the edge zone, wherein said recirculation duct constitutes an end portion of the tubular element and wherein said recirculation or movement means is mounted in said tubular element.

13. The swimming pool structure according to claim 11, wherein said recirculation or movement means is mounted at the first end of the tubular element and wherein said swimming pool structure comprises a containment component removably mounted on the first end and designed to contain the recirculation or movement means inside the tubular element.

14. A process for maintaining the swimming pool structure according to claim 1, comprising the following steps removing a segment or tile or grid of said top wall above said at least one well zone (WZ) to enable access the at least one well zone (WZ), and extracting said at least one filter and disassembling and extracting said recirculation or movement means.

15. The process according to claim 14, wherein said steps are carried out by an operator remaining at the edge zone and further comprising the steps of inserting, starting from this edge zone, one or both arms in the well zone (WZ) and reaching said at least one filter and said recirculation or movement means.

16. A swimming pool structure according to claim 1, wherein said recirculating or movement means comprises a pump equipped with electronics to read voltage variations for detecting possible no-load operation, including a lack of water.

17. The swimming pool structure according to claim 16, wherein the lack of water is caused by clogging of the filter, an insufficient level of water in the pool or by obstruction of the recirculation duct.

* * * * *